US006629497B2

(12) United States Patent
Tokiwa

(10) Patent No.: US 6,629,497 B2
(45) Date of Patent: Oct. 7, 2003

(54) INK PUMP CONTROL APPARATUS

(75) Inventor: Shizurou Tokiwa, Zushi (JP)

(73) Assignee: Tokyo Kikai Seisakusho, Ltd. (JP)

( * ) Notice: Subject to any disclaimer, the term of this patent is extended or adjusted under 35 U.S.C. 154(b) by 134 days.

(21) Appl. No.: 09/942,348

(22) Filed: Aug. 29, 2001

(65) Prior Publication Data

US 2002/0078845 A1 Jun. 27, 2002

(30) Foreign Application Priority Data

Nov. 8, 2000 (JP) ..... 2000/339791

(51) Int. Cl.[7] ..... B41F 31/02
(52) U.S. Cl. ..... 101/365; 101/366
(58) Field of Search ..... 101/365, 366, 101/148, 331

(56) References Cited

U.S. PATENT DOCUMENTS

| | | | | | |
|---|---|---|---|---|---|
| 3,608,486 | A | * | 9/1971 | McDonald et al. | 101/365 |
| 5,182,993 | A | * | 2/1993 | Shiba et al. | 101/365 |
| 5,398,605 | A | * | 3/1995 | Tokiwa | 101/366 |
| 5,575,208 | A | * | 11/1996 | Kirihara | 101/366 |
| 5,957,051 | A | * | 9/1999 | Atwater | 101/366 |
| 2002/0078845 | A1 | * | 6/2002 | Tokiwa | 101/365 |

FOREIGN PATENT DOCUMENTS

| | | | | |
|---|---|---|---|---|
| EP | 0 422 365 | | 4/1991 | |
| EP | 0 995 598 | | 4/2000 | |
| EP | 1 205 299 | A2 * | 2/2001 | ..... B41F/33/00 |
| JP | H01-174446 | A | 7/1989 | |
| JP | H01-174447 | A | 7/1989 | |
| JP | 2622072 | | 4/1997 | |
| JP | 2644181 | | 5/1997 | |

OTHER PUBLICATIONS

Translation of IDS reference JP 2622072.*

Translation of IDS reference JP 2644181.*

* cited by examiner

*Primary Examiner*—Charles H. Nolan, Jr.
(74) *Attorney, Agent, or Firm*—McGlew and Tuttle, P.C.

(57) ABSTRACT

This ink pump control apparatus has a mechanism for controlling the operation of ink pumps by inputting data corresponding to the printing image ratio of an area to which ink is fed, detecting the printing speed of the printing press and outputting a printing speed signal corresponding to the printing speed, judging changes in printing speed based on the printing speed signal, storing in a memory section first correction coefficients determined by printing image ratios and third correction coefficients determined by acceleration and deceleration of printing speed, fetching from the memory section coefficients determined based on the printing image ratios and speed change judgement result, calculating an ink feed correction coefficient from these coefficients and the printing speed, and outputting a signal to operate the ink pumps so that an amount of ink corrected by the ink feed correction coefficient can be fed.

13 Claims, 4 Drawing Sheets

INK PUMP CONTROL APPARATUS

BACKGROUND OF THE INVENTION

1. Field of the Invention

The present invention relates generally to an ink pump control apparatus for printing presses, and more particularly to an ink pump control apparatus for controlling the revolution of an ink pump drive unit to control the feed rate of ink on the basis of printing speed and printing-image ratio (the ratio of printing-image area to the sum of printing-image area and non-image area).

2. Description of the Related Art

An ink pump control apparatus for controlling the revolution of an ink pump drive unit on the basis of printing speed and printing-image ratio to control the feed rate of ink has been disclosed in Japanese Patent Publication Nos. 2622072 and 2644181, for example.

The ink pump control apparatuses disclosed in these patent journals are designed to control the feed rate of ink by controlling the revolution of the ink pump drive unit in such a manner as to be proportional to printing speed in accordance with a predetermined coefficient for each printing-image ratio.

In ink feeding using an ink pump controlled in the aforementioned manner, printed materials of inappropriate printing densities tend to be produced due to differences in the degree of ink color development caused by changing the ink being in the accelerating stage at the start of printing and in the decelerating stage at the end of printing.

In ink feeding using an ink pump, ink is usually fed to the printing plate surface of the printing cylinder via an ink path comprising a plurality of rotating bodies such as an ink rail, an ink cylinder, an ink ductor, an ink form roller, etc.

In the accelerating stage at the start of printing, relatively long time is required until a sufficient amount of ink to print on a printing material with an appropriate printing density reaches the printing plate surface. As a result, printed materials of low printing densities tend to be produced.

In the decelerating stage at the end of printing, on the other hand, neither too much nor too little ink for printing at that point of time is retained on the surfaces of rollers and ink cylinders constituting the ink path. Nevertheless, as the printing press is decelerated to a halt, the number of printing materials to be printed in a unit of time is decreased rapidly. This results in an excessive amount of ink retained on the roller and cylinder surfaces, and the amount of ink supplied to the printing plate surface becomes more than the correct level, leading to generation of printed material of high printing densities.

The printing density of printing materials may vary because the degree of color development is apt to change with a change in ink color, or with a change in color pigment or solvent (that is, with a change in ink types) even when the ink is of the same color. As a result, even if the same amount of ink is fed, that is, even if the revolution of the ink pump drive unit is controlled in such a manner as to become proportional to printing speed in accordance with a predetermined coefficient, as described earlier, printing materials of inappropriate printing densities are often produced.

To cope with these inappropriate conditions, the operator can correct such improper printing densities by temporarily controlling the ink pump manually. Manual control, however, is not effective in reducing printed matter having improper printing densities because it involves extremely difficult operation requiring a lot of skill. Furthermore, it is a time-consuming operation because the state of printing has to be carefully observed during operation.

SUMMARY OF THE INVENTION

It is one object of the present invention to reduce running cost incurred due to production of a large amount of printed materials having improper printing densities by minimizing such printed materials having improper printing densities by automatically adjusting the feed rate of ink so that the printing density can be maintained at a proper level in the accelerating stage at the start of printing and in the decelerating stage at the end of printing, as described above.

It is another object of the present invention to reduce running cost incurred due to production of a large amount of printed materials having improper printing densities by minimizing such printed materials having improper printing densities by automatically adjusting the feed rate of ink in accordance with the degree of color development of the ink so that printing density can be maintained at a proper level even when the color of ink used varies, or even when ink used is of the same color but contains a different color pigment or solvent, that is, even when a different brand of ink is used.

The present invention provides an ink pump control apparatus used in a printing press where the feed rate of ink is caused to change by ink pumps based on printing image ratio and printing speed. The ink pump control apparatus comprises an image ratio input section to input data corresponding to the printing image ratio of an area to which ink is to be fed, a printing speed detecting section to detect the printing speed of the printing press and outputting a printing speed signal corresponding to the detected printing speed, a speed judgement section to judge a change in printing speed based on the printing speed signal output by the printing speed detecting section, a memory section to store first correction coefficients determined for different printing image ratios and third correction coefficients determined for the acceleration and deceleration of printing speed, and a processing section to fetch the first and third correction coefficients from the memory section based on the data corresponding to the printing image ratio and the judgement results of speed changes output by the speed judgement section, obtaining an ink feed correction coefficient from these coefficients and the printing speed, and outputting a signal for operating the ink pump so as to feed the amount of ink corrected by the ink feed correction coefficient; so that the operation of the ink pump is controlled based on the data corresponding to the printing image ratio and the judgement results of speed changes and the printing speed.

With the aforementioned construction, the printing image ratio of an area to which ink is fed by the ink pump is input into the processing section via the image ratio input section. Where ink type designation is needed, the designation of the type of ink to be used is input to the processing section by an ink designation section.

Upon receipt of a printing image ratio, the processing section fetches a first correction coefficient corresponding to the printing image ratio from among the first correction coefficients in the memory section. Where the type of ink used is designated, a second correction coefficient corresponding to the designated ink is fetched from among the second correction coefficients in the memory section.

In this state, the printing press is started. Then, printing press operating speed, that is, a signal corresponding to a printing speed is generated and input into the printing speed detecting section. The printing speed detecting section detects the printing speed of the printing press from the signal corresponding to the input printing press operating speed at predetermined time intervals, for example, and outputs a printing speed signal corresponding to the detected printing speed. The printing speed signal output by the printing speed detecting section is input into the speed judgement section and the processing section.

Upon receipt of the printing speed signal, the speed judgement section compares the currently input printing speed signal with a previously input printing speed signal to judge whether the printing speed is accelerated or decelerated, or remains unchanged, and outputs the judgement result in the form of a signal. The signal output by the speed judgement section is input into the processing section.

The processing section, to which the printing speed signal and the signal of the printing speed judgement result are input following the start of the printing press, fetches a third correction coefficient corresponding to the input printing speed judgement result from among the third correction coefficients in the memory section, and decides the first, second and third correction coefficients based on the printing speed signal. Furthermore, the processing section calculates an ink feed correction coefficient based on the determined first, second and third correction coefficients, and outputs a signal for operating the ink pump to feed the amount of ink corrected with the obtained ink feed correction coefficient.

DESCRIPTION OF THE PREFERRED EMBODIMENT

Figure 1:
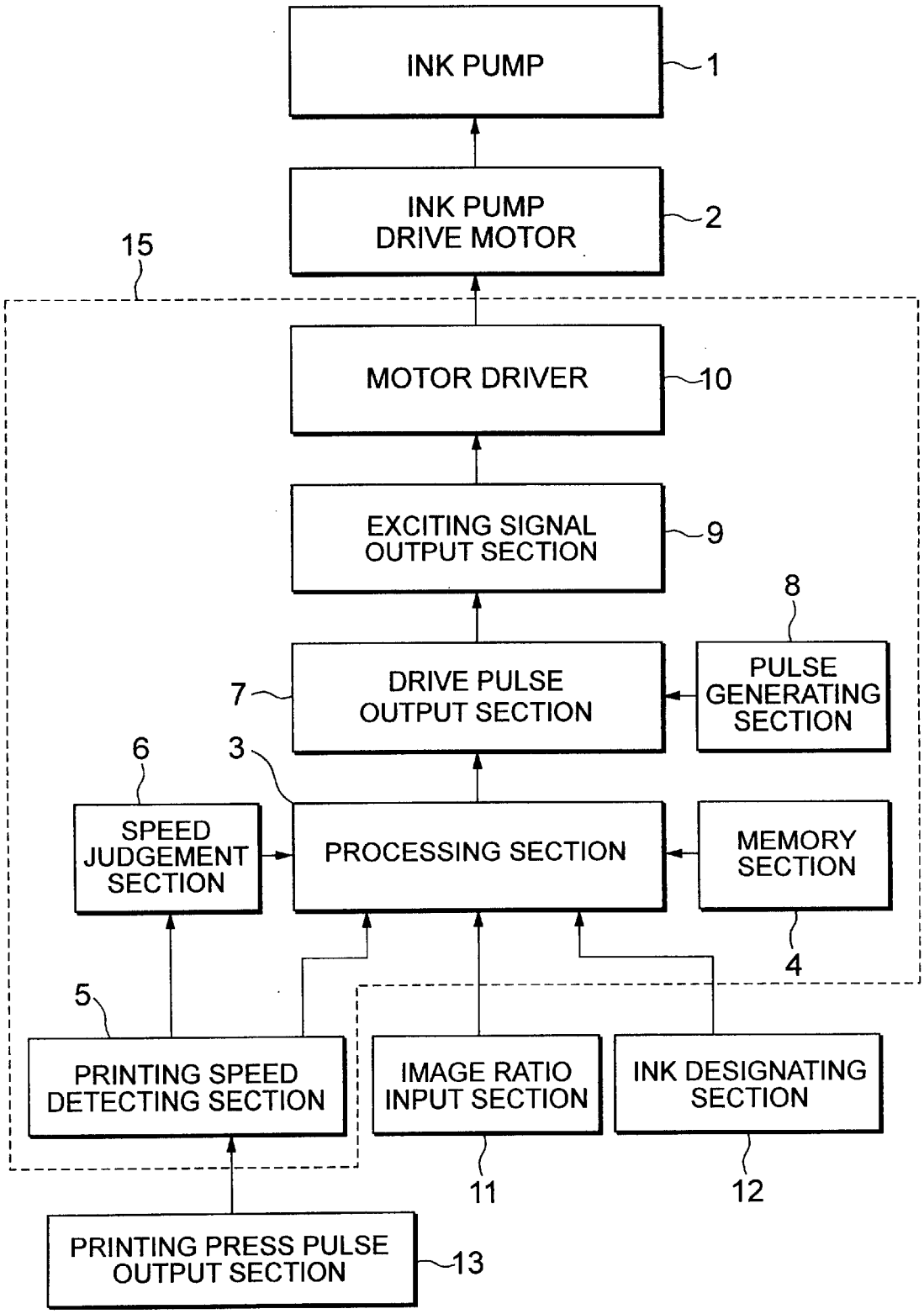
FIG. 1 is a block diagram showing the basic configuration of an embodiment of the present invention.

FIG. 1 is a block diagram showing the basic configuration of the present invention. In FIG. 1, an ink pump 1 is a controlled object that feeds ink to a printing press in accordance with at least a printing speed and a printing image ratio.

Numeral 2 refers to a stepping motor that is an ink pump drive unit for driving the ink pump 1.

A processing section 3 selects and decides several predetermined coefficients based on several data input for a printing job, and perform calculations using the decided coefficients to obtain the revolution Rn of the stepping motor 2 necessary for feeding ink for the printing job.

Into the processing section 3 input are the data corresponding to the printing image ratio of a printing material to which ink is to be fed by the ink pump 1 for the printing job from the image ratio input section 11, ink designation from the ink designating section 12, and the data corresponding to printing speed from the printing speed detecting section 5, respectively. Furthermore, the judgement result of speed changes is input into the processing section 3 from the speed judgement section 6. Needless to say, if ink designation is not needed, there is no input from the ink designating section 12, and if the judgement result of speed changes is not needed, then there is no input from the speed judgement section 6.

As the data corresponding to printing image ratio, the value based on the image ratio value obtained by scanning a plate-making film, for example, or the value based on the image ratio value obtained from a plate-making electronic image is used. As the data corresponding to printing speed, the number of output pulses per unit of time from the printing press pulse output section 13 operating in conjunction with a printing press drive section 21, for example (refer to FIG. 2, which will be described later), or the revolution per unit of time of a driven component (such as a plate cylinder) obtained by calculating based on the number of output pulses is used.

The memory section 4 stores several coefficients to be selected by the processing section 3 based on the input data. The coefficients stored in the memory section 4 includes (i) first correction coefficients Xn determined in advance corresponding to printing speeds for each printing image ratio, as shown in TABLE 1 which is a table of first correction coefficients determined corresponding to printing speeds for each printing image ratio, (ii) second correction coefficients Yn determined in advance corresponding to printing speeds for each ink type, as shown in TABLE 2 which is a table of second correction coefficients determined in advance corresponding to printing speeds for each ink type, and (iii) third correction coefficients Zn determined in advance corresponding to printing speeds for each state of change in printing speed, as shown in TABLE 3 which is a table of third correction coefficients determined in advance corresponding to printing speeds for each state of change in printing speed.

TABLE 1

| | Printing speed | | | | |
|---|---|---|---|---|---|
| Image ratio | $0 < V \leqq V1$ | $V1 < V \leqq V2$ | $V2 < V \leqq V3$ | $V3 < V \leqq V4$ | $V4 < V \leqq V_{max}$ |
| N0 | X001 | X012 | X023 | X034 | X04 m |
| N1 | X101 | X112 | X123 | X134 | X14 m |
| N2 | X201 | X212 | X223 | X234 | X24 m |
| . | . | . | . | . | . |

TABLE 1-continued

| Image ratio | Printing speed | | | | |
|---|---|---|---|---|---|
| | $0 < V \leqq V1$ | $V1 < V \leqq V2$ | $V2 < V \leqq V3$ | $V3 < V \leqq V4$ | $V4 < V \leqq V_{max}$ |
| . | . | . | . | . | . |
| . | . | . | . | . | . |
| Nn | Xn01 | Xn12 | Xn23 | Xn34 | Xn4 m |

TABLE 2

| Ink type | Printing speed | | | | |
|---|---|---|---|---|---|
| | $0 < V \leqq V1$ | $V1 < V \leqq V2$ | $V2 < V \leqq V3$ | $V3 < V \leqq V4$ | $V4 < V \leqq V_{max}$ |
| Ink 1 | Y101 | Y112 | Y123 | Y134 | Y14 m |
| Ink 2 | Y201 | Y212 | Y223 | Y234 | Y24 m |
| Ink 3 | Y301 | Y312 | Y323 | Y334 | Y34 m |
| . | . | . | . | . | . |
| . | . | . | . | . | . |
| . | . | . | . | . | . |
| Ink n | Yn01 | Yn12 | Yn23 | Yn34 | Yn4 m |

TABLE 3

| Accelera-tion/ deceleration | Printing speed | | | | |
|---|---|---|---|---|---|
| | $0 < V \leqq V1$ | $V1 < V \leqq V2$ | $V2 < V \leqq V3$ | $V3 < V \leqq V4$ | $V4 < V \leqq V_{max}$ |
| Acceleration | $Z_{a01}$ | $Z_{a12}$ | $Z_{a23}$ | $Z_{a34}$ | 1 |
| No acceleration/ deceleration | 1 | 1 | 1 | 1 | 1 |
| Deceleration | $Z_{b01}$ | $Z_{b12}$ | $Z_{b23}$ | $Z_{b34}$ | 1 |

Figure 4:
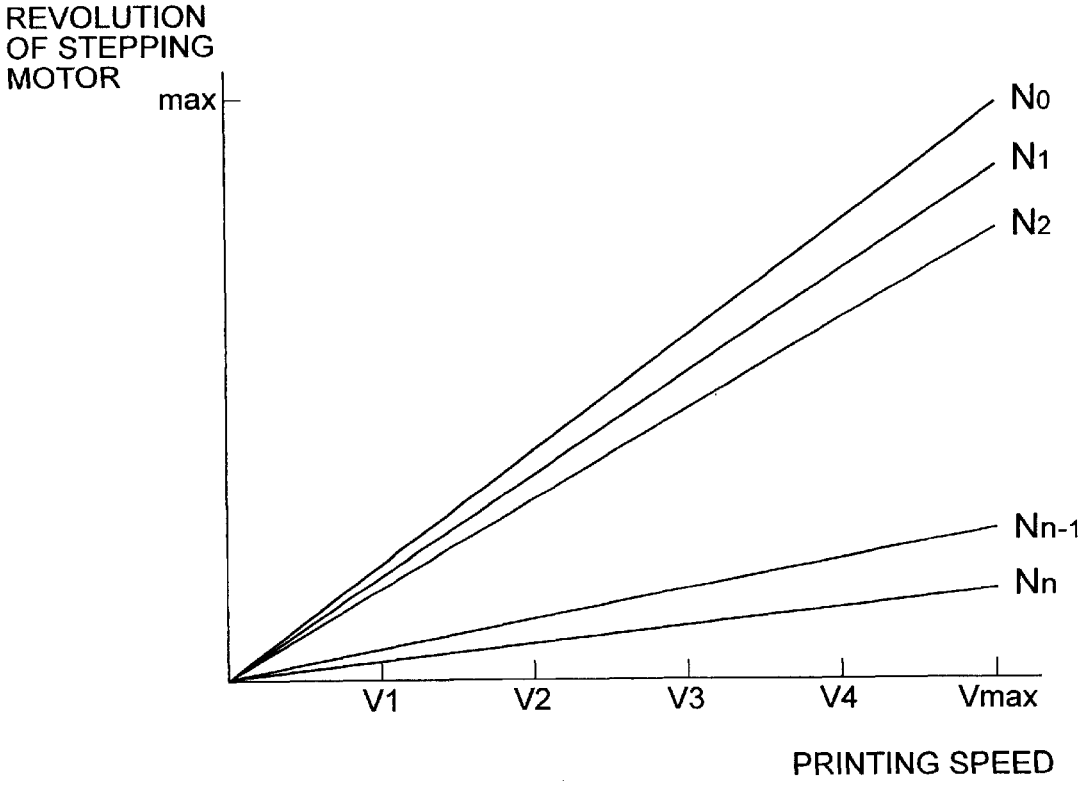
FIG. 4 is a graph showing the standard revolution of a stepping motor 2 corresponding to a printing speed for each printing image ratio, that is, the revolution of the stepping motor 2 adjusted by a first correction coefficient Xn.

The first correction coefficient Xn is a coefficient with which the revolution of the stepping motor 2 required to feed a necessary amount of ink for each printing image ratio, that is, the standard revolution of the stepping motor 2 suitable for carrying out the standard ink feed, when printing is performed at a constant printing speed using normal ink can be obtained. The aforementioned standard ink feed rate is generally determined so as to be proportional to printing speed. The first correction coefficient Xn is determined so that it can be obtained as a value proportional to the printing speed V and corresponding to the printing image ratio N, as shown in FIG. 4. In the example shown in FIG. 4, X001, X012, X023, X034, and X04*m* in TABLE 1 are the same value, and similarly, Xn01, Xn12, Xn23, Xn34, and Xn4*m* are the same value.

The second correction coefficient Yn is determined so that the standard revolution of the stepping motor 2 obtained using the first correction coefficient Xn can be increased or decreased so as to obtain the revolution of the stepping motor 2 suitable for feeding the necessary amount of ink for each printing image ratio when printing is performed at a predetermined speed using an ink type which must be fed in an amount different from that of a normal ink, such as an ink type which has lower color development than the normal ink and therefore must be fed in an increased amount, or an ink type which has higher color development than the normal ink and therefore must be fed in a reduced amount.

The third correction coefficient Zn is a coefficient with which the acceleration coefficient Zan and the deceleration coefficient Zbn are determined.

Figure 5:
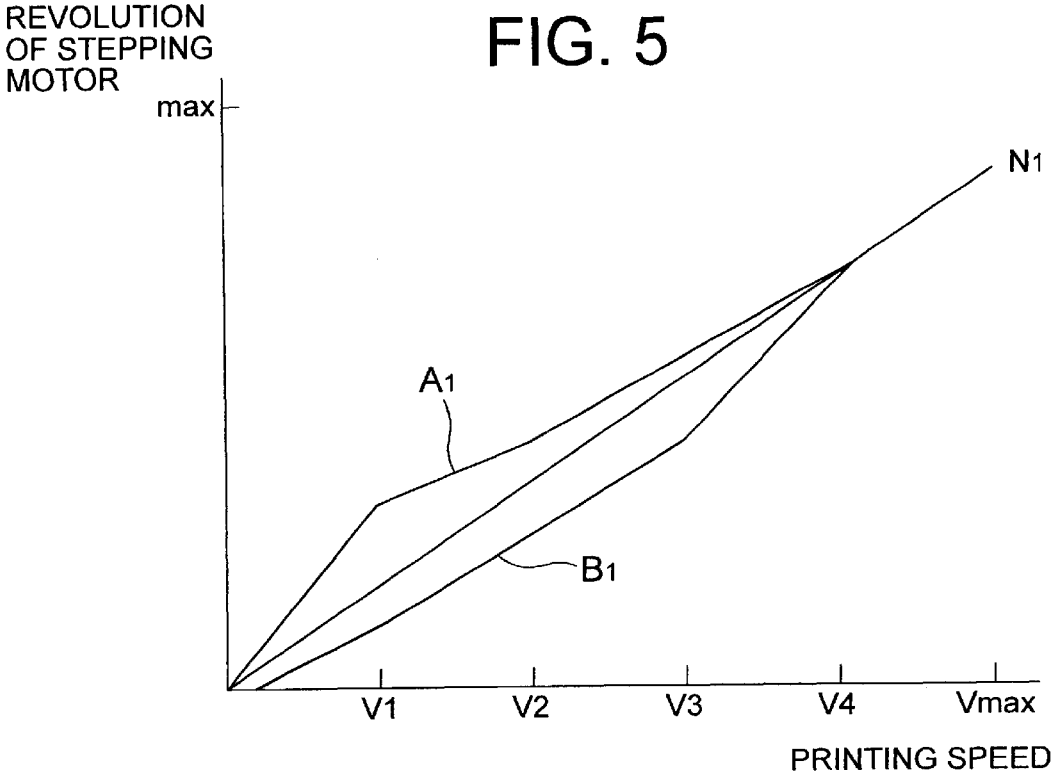
FIG. 5 is a graph showing the standard revolutions of the stepping motor 2 corresponding to specific printing speeds, the revolution of the stepping motor 2 adjusted by an acceleration constant Zan of the third correction coefficient Zn, and the revolution of the stepping motor 2 adjusted by a deceleration constant Zbn of the third correction coefficient Zn.

To prevent the amount of ink fed to the printing plate surface from falling short during the initial acceleration period in the entire acceleration process from the start of operation of the printing press till the printing press reaches a predetermined normal operation speed, as shown by A1 in FIG. 5, when a printing image of a printing image ratio N1, for example, is printed with a normal type of ink, the acceleration coefficient Zan is determined in such a manner as to increase the standard revolution of the stepping motor 2 obtained with the abovementioned first correction coefficient Xn at an appropriate rate so that the stepping motor 2 can achieve a revolution exceeding the standard revolution during the acceleration period from the start of the printing press till the printing press reaches a predetermined printing speed (speed V4 in the figure) and so that the stepping motor 2 can achieve a revolution equal to the standard revolution during the period from the abovementioned predetermined printing speed till the printing press reaches the maximum printing speed to obtain an ink feed rate exceeding the standard ink feed rate.

To prevent the amount of ink fed to the printing plate surface from becoming excessive in the deceleration process in which the printing press stops from the normal operation speed, when a printing image of a printing image ratio N1, for example, is printed with a normal type of ink, as shown by B1 in FIG. 5, the deceleration coefficient Zbn is determined in such a manner as to decrease the standard revolution of the stepping motor 2 obtained with the abovementioned first correction coefficient Xn at an appropriate rate so that the stepping motor 2 can achieve a revolution less than the standard revolution, or so that the stepping motor 2 can stop at an ink feed stopping speed before the printing press, such an offset printing press, stops to obtain an ink feed rate less than the standard ink feed rate during the period from a predetermined printing speed (speed V4 in the figure) to the stop.

FIG. 5 shows the standard revolutions of the stepping motor 2 corresponding to the acceleration side (A1) and the deceleration side (B1) in the printing image ratio N1. Similarly, acceleration and deceleration stages are provided for each case corresponding to the printing image ratios of N0, N2, . . . Nn.

The drive pulse output section 7 generates drive pulses for causing the stepping motor 2 to rotate at a revolution Rn of the stepping motor 2 needed for feed ink based on basic pulses of such a frequency as to cause the stepping motor 2 to rotate at a speed higher than the revolution Rm necessary to feed the largest amount of ink needed for printing by the printing press that are generated by the pulse generating section 8, and the revolution Rn.

An exciting signal output section 9 generates an exciting signal that is fed to the motor coil of each phase of the stepping motor 2 based on the output of the drive pulse output section 7.

A motor driver 10 amplifies the power of the exciting current output by the exciting signal output section 9 to feed an exciting current to the motor coil of the corresponding phase.

Figure 2:
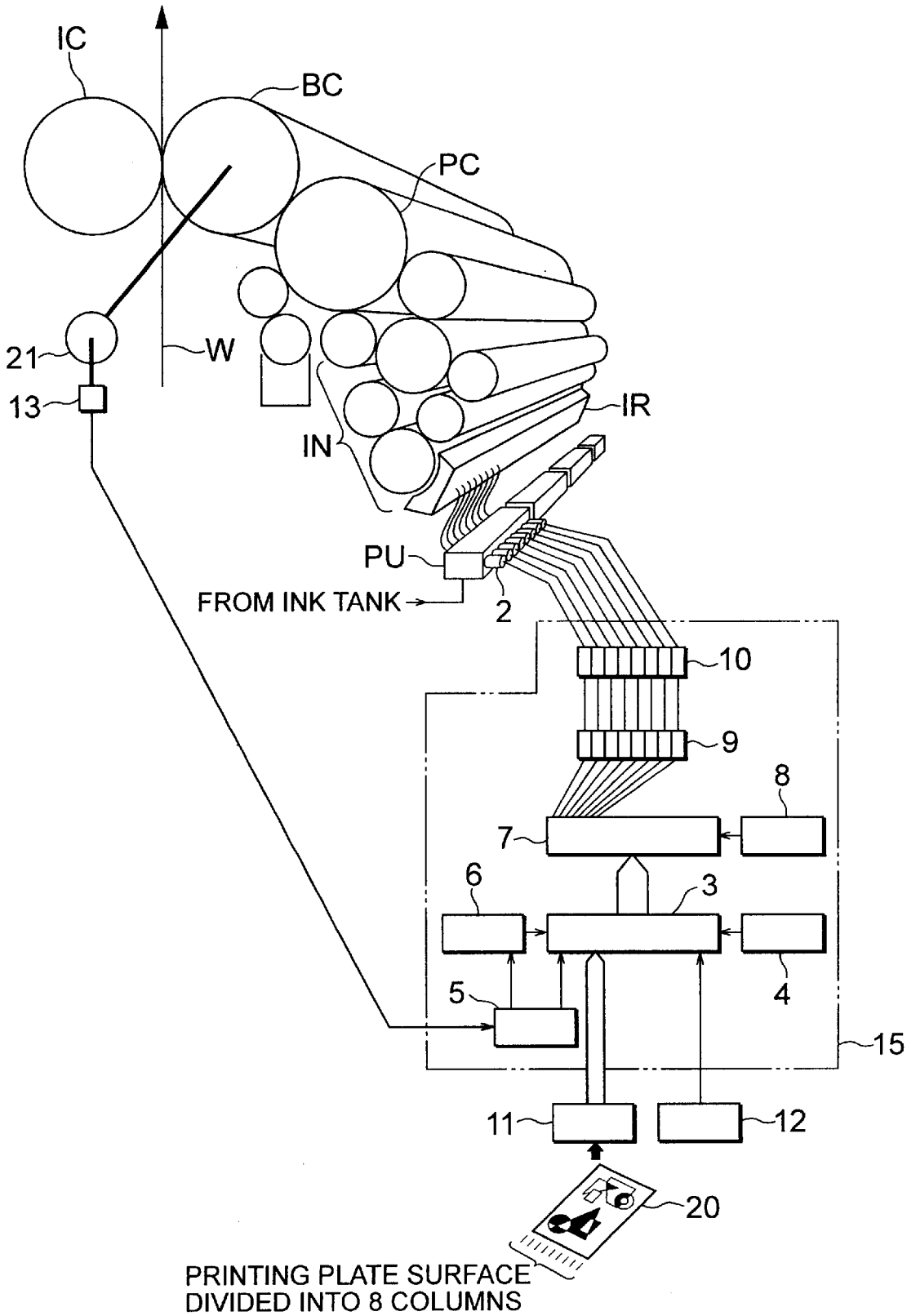
FIG. 2 is a diagram showing an embodiment of the present invention applied to a newspaper offset press.

FIG. 2 shows an example in which the present invention was applied to a newsprint offset press.

In the printing press shown in FIG. 2, a paper web W is passed between an impression cylinder IC and a blanket cylinder BC, and ink is fed to a printing plate having an eight-page content by an inking assembly IN to print an image on the printing plate on the paper web W via the surface of a blanket mounted on the blanket cylinder BC.

The plate cylinder PC shown in FIG. 2 can hold a printing plate having a total of eight pages of a newspaper; four pages in the axial direction and two pages in the circumferential direction. The plate cylinder PC is divided into eight areas (columns) for each page-width of a news paper in the axial direction; an ink pump allocated for each area (column) and eight ink pumps being assembled into an ink pump unit PU for feeding ink over a full 1-page width of a newspaper on the plate cylinder PC.

Each ink pump in the ink pump unit PU has an individual stepping motor 2 that is an ink pump drive motor. The stepping motor 2 is a motor that rotates in 200 angular steps (an angular step: 1.8 degrees), for example, whose revolving speed Rm for driving an ink pump to ensure the supply of the maximum required amount of ink for a printing operation, that is, the supply of a necessary and sufficient amount of ink to a column of the maximum image ratio (100%) is set to 120 revolutions per minute.

The suction side of the ink pump is connected to an ink tank (not shown) with piping, and the delivery side thereof is connected to an ink rail IR of the inking assembly IN with piping.

To avoid complexity, the figure shows the stepping motor 2 only for one ink pump unit PU, and similarly an exciting signal output section 9 and a motor driver 10 are shown in FIG. 2 only for one ink pump unit PU.

A control unit 15 comprises a processing section 3, a memory section 4, a printing speed detecting section 5, a speed judgement section 6, a drive pulse output section 7, a pulse generating section 8, an exciting signal output section 9, and a motor driver 10. The functions and operations of these sections are as described earlier. In FIG. 2, numeral 11 refers to an image ratio input section, 12 to an ink designating section, 13 to a printing press pulse output section, 21 to a motor as a printing press drive unit, and 20 to a printing plate, respectively.

Figure 3:
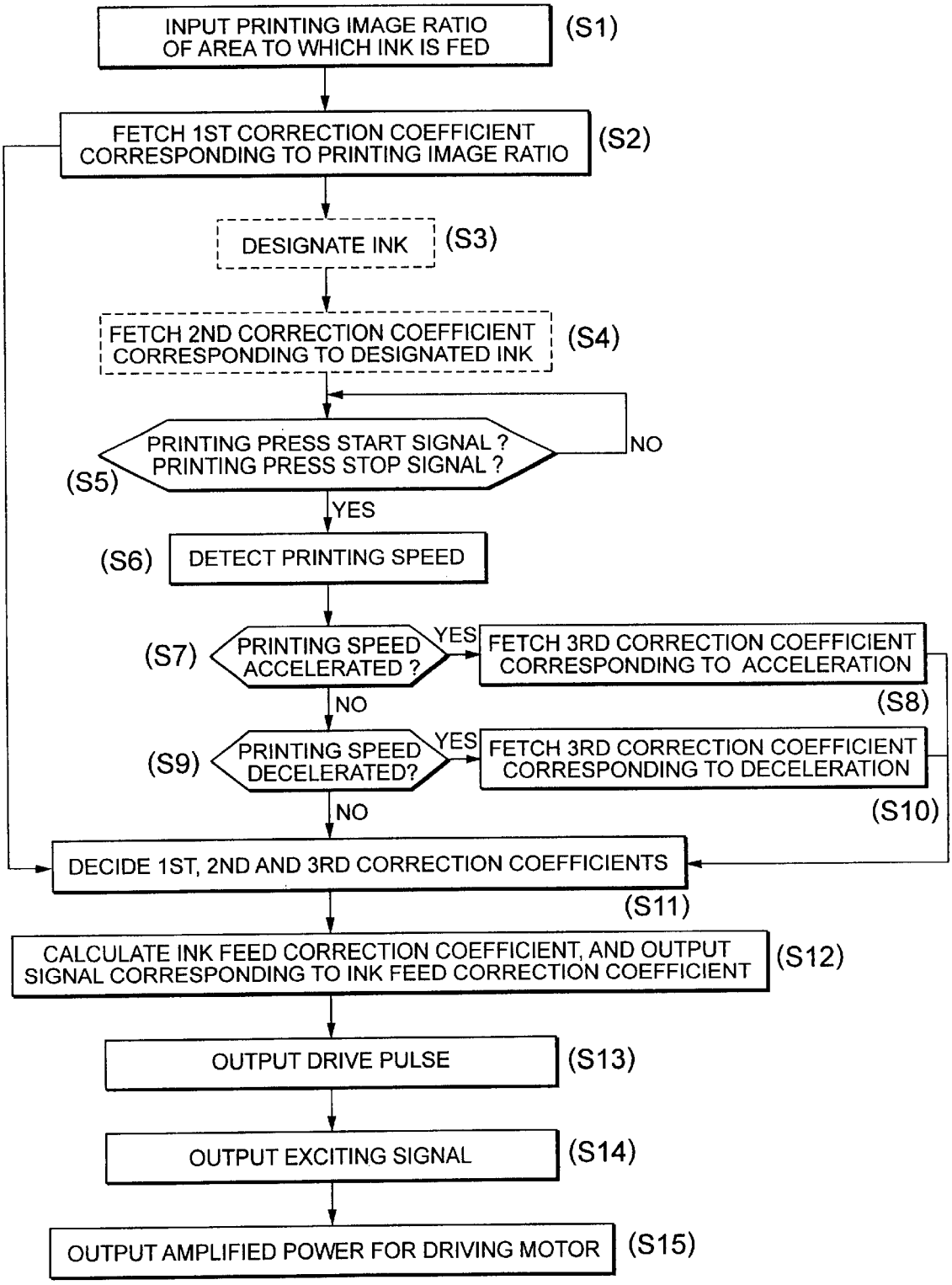
FIG. 3 is a flow chart showing the operation of the embodiment shown in FIG. 2.

The operation of the embodiment having the abovementioned construction will be described in the following, referring to the flow chart shown in FIG. 3.

Prior to a printing operation, the data on the printing operation are first input into the processing section 3. That is, the data on a printing image ratio for each column on the printing plate 20 obtained by some appropriate means are input from the image ratio input section 11. The ink used for the printing operation is designated by the ink designating section 12 as necessary. Then, the processing section 3 fetches from the memory section 4 the first correction coefficient Xn corresponding to the input printing image ratio, that is, the "line" of the first correction coefficient Xn corresponding to the relevant image ratio in TABLE 1. The processing section 3 also fetches from the memory section 4 the second correction coefficient Yn corresponding to the input ink designation, that is, the "line" of the second correction coefficient Yn corresponding to the relevant designated ink in TABLE 2 (Steps S1–S4).

In this state, the printing press drive section 21 is activated to cause the printing press to start printing.

Then, the printing press pulse output section 13 connected to the printing press drive section 21 outputs pulses the number of which per unit of time is proportional to the revolving speed of the printing press drive section 21. This pulse output is processed in the printing speed detecting section 5 into a printing speed signal, which is output in the form of the number of output pulses per unit of time, or the revolution per unit of time of the driven components (the plate cylinder, etc.) obtained based on the number of output pulses, or other appropriate value based on these values (Step S5).

The printing speed signal output by the printing speed detecting section 5 is brought in the processing section 3 and the speed judgement section 6.

The speed judgement section 6 takes in the printing speed signal output by the printing speed detecting section 5 every predetermined hour, compares the currently taken-in printing speed signal with the previously taken-in printing speed signal to judge whether the operating speed of the printing press, that is, printing speed is accelerating or decelerating, or remains unchanged, and outputs the judgement result in the form of a signal.

The speed judgement section 6 performs the judgement of printing speed only during the period from the start signal of the printing press till the printing press reach a predetermined normal operation printing speed and till the press comes to a halt upon receipt of the stop signal. Consequently, once the printing press reaches the normal operating speed upon receipt of a start signal, the speed judgement section 6 keeps outputting a no-acceleration/deceleration signal even if there is an acceleration or deceleration in printing speed during printing operation for some reason or other unless a deceleration is instructed by a stop signal (Step S6).

Every time the speed judgement section 6 outputs a signal, the processing section 3 updates the signal output or the output signal. More specifically, the processing section 3 takes in the printing speed output by the printing speed detecting section 5 and the speed judgement result signal output by the speed judgement section 6. The third correction coefficient Zn corresponding to the speed judgement result, that is, the "line" of the third correction coefficient Zn corresponding to the input speed judgement result in TABLE 3 is fetched from the memory section 4. Furthermore, the first correction coefficient Xn, the second correction coefficient Yn and the third correction coefficient Zn are decided based on the printing speed signal as the first correction coefficient Xk, the second correction coefficient Yk and the third correction coefficient Zk that are values corresponding to the relevant printing speeds (Steps S7–S11).

Next, the ink feed correction coefficient Ik is calculated based on the decided first, second and third correction coefficients Xk, Yk and Zk by the following equation.

$$Ik=Xk\times Yk\times Zk.$$

The signal corresponding to the calculated ink feed correction coefficient Ik, that is, the revolution of the stepping motor 2 corresponding to the ink feed correction coefficient Ik, that is, the revolution Rk of the stepping motor 2 needed for ink feeding for printing at the ink feed correction coefficient Ik is calculated by the following equation.

$$Rk=Ik\times Rm+C \quad (C\text{: a constant including } 0)$$

The calculated revolution Rk of the stepping motor 2 is output in the form of an appropriate signal. In the above calculations, the second correction coefficient Yn when there is no ink designation is "1," and the third correction coefficient Zn when there is no speed judgement result is "1. " C is a properly selected constant.

As printing speed does not change any longer (the printing press enters into a steady-state operation) within the printing speed range where the speed judgement section 6 performs speed judgement, the processing section 3 outputs a signal so that the revolution Rk of the stepping motor 2 gradually reaches the standard speed after the lapse of a predetermined time (Step S12).

The signal designating the revolution Rk of the stepping motor 2 output by the processing section 3 is input into the drive pulse output section 7. Upon receipt of the signal designating the revolution Rk of the stepping motor 2, the drive pulse output section 7 outputs a drive pulse obtained by reducing the basic pulse of 1 kHz, for example, into that of a frequency that can cause the stepping motor 2 to rotate at the revolution Rk designated by the processing section 3 (Step S13).

The drive pulse output by the drive pulse output section 7 is input into the exciting signal output section 9. Upon receipt of the drive pulse, the exciting signal output section 9 generates and outputs an exciting signal in accordance with the drive pulse, amplifying power via a motor driver 10, causing the stepping motor 2 to rotate at the revolution Rk designated by the processing section 3 (Steps S14 and S15).

When the printing press is stopped with a stop signal to complete the printing operation, the printing press begins deceleration upon receipt of the stop signal, and performs the operations of Steps S5 through S15 until the printing press stops.

As described above, the ink pump can be controlled so as to prevent an insufficient amount of ink from being fed to the printing press during the acceleration stage at the start of printing operation, and an excessive amount of ink from being fed during the deceleration stage at the end of printing operation. Even when an ink type having different color development is used, the ink pump can be operated to ensure a proper ink supply.

By applying the present invention, generation of printed materials having improper printing densities during acceleration stage at the start of printing, and during deceleration stage at the end of printing can be minimized or eliminated. As a result, a large sum of running cost involved with the generation of printed materials having improper printing densities that have heretofore been a big problem can be reduced materially.

Even when various types of ink having different degrees of color development are used, the feed rate of ink can be adjusted in accordance with the type of ink used. As a result, generation of printed materials having improper densities or improper color balance can be minimized or eliminated. Thus, a large sum of running cost involved with the generation of printed materials having improper densities or improper color balance that have heretofore been a big problem can be reduced materially.

What is claimed is:

1. An ink pump control apparatus for use in a printing press by changing the feed rate of ink by ink pumps based on printing image ratio and printing speed, the ink pump control apparatus comprising:

an image ratio input section to input data corresponding to a printing image ratio for an area of a printing material to which ink is fed;

a printing speed detecting section to detect the printing speed of the printing press and to output a printing speed signal corresponding to the printing speed;

a speed judgement section to judge changes in printing speed based on the printing speed signal output by the printing speed detecting section;

a memory section to store first correction coefficients determined by printing image ratios, and third correction coefficients determined by acceleration and deceleration of printing speed; and a processing section to fetch from the memory section the first and third correction coefficients based on data corresponding to the input printing image ratios and the speed change judgement result output by the speed judgement section, to calculate an ink feed correction coefficient from these coefficients and the printing speed, and to output a signal to operate the ink pump so that the amount of ink corrected by the ink feed correction coefficient can be fed, wherein the ink pump control apparatus controls the operation of the ink pumps based on the data corresponding to the printing image ratio, the speed change result, and the printing speed.

2. An ink pump control apparatus for use in a printing press by changing the feed rate of ink by ink pumps based on printing image ratio and printing speed, the ink pump control apparatus comprising:

an image ratio input section to input data corresponding to a printing image ratio for an area of a printing material to which ink is fed;

an ink designating section to designate ink type being used;

a printing speed detecting section to detect the printing speed of the printing press and to output a printing speed signal corresponding to the printing speed;

a memory section to store first correction coefficients determined by printing image ratios, and second correction coefficients determined by ink type; and a processing section to fetch from the memory section the first and second correction coefficients based on data corresponding to the input printing image ratios and the input ink designation, to calculate an ink feed correction coefficient from these coefficients and the printing speed, and to output a signal to operate the ink pump so that the amount of ink corrected by the ink feed correction coefficient can be fed, wherein the ink pump control apparatus controls the operation of the ink pumps based on the data corresponding to the printing image ratio, the ink designation, and the printing speed.

3. An ink pump control apparatus for use in a printing press by changing the feed rate of ink by ink pumps based on printing image ratio and printing speed, the ink pump control apparatus comprising:

an image ratio input section to input data corresponding to a printing image ratio for an area of a printing material to which ink is fed;

an ink designating section to designate ink type being used;

a printing speed detecting section to detect the printing speed of the printing press and to output a printing speed signal corresponding to the printing speed;

a speed judgement section to judge changes in printing speed based on the printing speed signal output by the printing speed detecting section;

a memory section to store first correction coefficients determined by printing image ratios, and second correction coefficients determined by ink type, and third correction coefficients determined by acceleration and deceleration of printing speed; and a processing section to fetch from the memory section the first, second and third correction coefficients based on data corresponding to the input printing image ratios and the input ink designation and the speed change judgement result output by the speed judgement section, to calculate an ink feed correction coefficient from these coefficients and the printing speed, and to output a signal to operate the ink pump so that the amount of ink corrected by the ink feed correction coefficient can be fed, wherein the ink pump control apparatus controls the operation of the ink pumps based on the data corresponding to the printing image ratio, the ink designation, the speed change judgement result and the printing speed.

4. An ink pump control apparatus as set forth in claim 1, wherein the first correction coefficients are for calculating the standard revolution of drive units of the ink pumps feeding a required amount of ink for printing operation at a predetermined speed for each printing image ratio.

5. An ink pump control apparatus as set forth in claim 1, wherein the third correction coefficients are acceleration coefficients or deceleration coefficients; the acceleration coefficients being for increasing the standard revolution calculated based on the first correction coefficients at an appropriate ratio during acceleration stage until the printing press reaches a predetermined printing speed, and the deceleration coefficients being for decreasing the standard revolution calculated based on the first correction coefficients at an appropriate ratio during deceleration stage until the printing press is decelerated from the predetermined printing speed.

6. An ink pump control apparatus as set forth in claim 1, wherein the speed judgement section judges changes in printing speed during the period from the start of the printing press based on a start signal until the printing press reaches a predetermined normal operation printing speed, and until the printing press comes to a halt based on a stop signal.

7. An ink pump control apparatus as set forth in claim 2, wherein the first correction coefficients are for calculating the standard revolution of drive units of the ink pumps feeding a required amount of ink for printing operation at a predetermined speed for each printing image ratio.

8. An ink pump control apparatus as set forth in claim 2, wherein the second correction coefficients are for increasing or decreasing the standard revolution calculated based on the first correction coefficient at an appropriate ratio so that the drive units of the ink pumps can be controlled suitable for feeding a required amount of ink in accordance with the ink designation for each printing image ratio.

9. An ink pump control apparatus as set forth in claim 2, wherein the speed judgement section judges changes in printing speed during the period from the start of the printing press based on a start signal until the printing press reaches a predetermined normal operation printing speed, and until the printing press comes to a halt based on a stop signal.

10. An ink pump control apparatus as set forth in claim 3, wherein the first correction coefficients are for calculating the standard revolution of drive units of the ink pumps feeding a required amount of ink for printing operation at a predetermined speed for each printing image ratio.

11. An ink pump control apparatus as set forth in claim 3, wherein the second correction coefficients are for increasing or decreasing the standard revolution calculated based on the first correction coefficient at an appropriate ratio so that the drive units of the ink pumps can be controlled suitable for feeding a required amount of ink in accordance with the ink designation for each printing image ratio.

12. An ink pump control apparatus as set forth in claim 3, wherein the third correction coefficients are acceleration coefficients or deceleration coefficients; the acceleration coefficients being for increasing the standard revolution calculated based on the first correction coefficients at an appropriate ratio during acceleration stage until the printing press reaches a predetermined printing speed, and the deceleration coefficients being for decreasing the standard revolution calculated based on the first correction coefficients at an appropriate ratio during deceleration stage until the printing press is decelerated from the predetermined printing speed.

13. An ink pump control apparatus as set forth in claim 3, wherein the speed judgement section judges changes in printing speed during the period from the start of the printing press based on a start signal until the printing press reaches a predetermined normal operation printing speed, and until the printing press comes to a halt based on a stop signal.

* * * * *